US007616170B2

(12) United States Patent
Renfro et al.

(10) Patent No.: US 7,616,170 B2
(45) Date of Patent: Nov. 10, 2009

(54) SYSTEM, METHOD AND APPARATUS FOR SUPPORTING AND CONCEALING RADIO ANTENNAS

(75) Inventors: Robert Renfro, San Diego, CA (US); Rodger Smith, San Diego, CA (US)

(73) Assignee: Solar Communications International, Inc., San Diego, CA (US)

( * ) Notice: Subject to any disclaimer, the term of this patent is extended or adjusted under 35 U.S.C. 154(b) by 55 days.

(21) Appl. No.: 11/778,476

(22) Filed: Jul. 16, 2007

(65) Prior Publication Data

US 2008/0012784 A1 Jan. 17, 2008

Related U.S. Application Data

(60) Provisional application No. 60/807,598, filed on Jul. 17, 2006.

(51) Int. Cl.
*H01Q 1/12* (2006.01)

(52) U.S. Cl. ..... 343/890; 52/40; 52/651.02; 52/651.07

(58) Field of Classification Search ..... 343/890, 343/874, 891; 52/40, 736.2, 736.3, 651.02, 52/651.07

See application file for complete search history.

(56) References Cited

U.S. PATENT DOCUMENTS

| | | | |
|---|---|---|---|
| D27,516 | S | 8/1897 | Brownlee |
| 857,152 | A | 6/1907 | Brown |
| D51,751 | S | 2/1918 | Danielson |
| 1,306,885 | A | 6/1919 | Coe |
| 1,312,901 | A | 8/1919 | Schmidt |
| D60,295 | S | 1/1922 | Petersen |
| D67,697 | S | 6/1925 | Hansen |
| D75,322 | S | 5/1928 | Barkschat |
| D112,288 | S | 11/1938 | Martin |
| 2,220,428 | A | 6/1940 | Stevens |
| 3,242,901 | A | 3/1966 | Olson |
| 3,358,952 | A | 12/1967 | Burns |
| 3,555,552 | A | 1/1971 | Alford |
| 3,579,929 | A | 5/1971 | Holthearichs |
| D251,298 | S | 3/1979 | Altmayer |
| 4,356,498 | A | 10/1982 | Pollard |
| D270,054 | S | 8/1983 | Spycher |
| 4,603,333 | A | 7/1986 | Carlson |
| 4,800,834 | A | 1/1989 | Feng |

(Continued)

OTHER PUBLICATIONS

International Searh Report and The Written Opinion of the International Search Authority issued in PCT/US07/73713 on Feb. 13, 2008.

*Primary Examiner*—Hoang V Nguyen
(74) *Attorney, Agent, or Firm*—Pattric J. Rawlins; Procopio Cory Hargreaves & Savitch LLP

(57) ABSTRACT

A multi-trunk antenna structure that includes a main trunk and a plurality of upper trunks. The upper trunks extend upwardly at a desired angle from the main trunk and provide a desired girth of the structure near the top. A plurality of antennas are attached to desired upper trunks at a desired height above ground level. The antennas can be adjusted to a desire azimuth. The antenna structure can include branches so that it resembles a Eucalyptus tree, an Oak tree, or other type of tree. The trunks of the structure can provide raceways for antenna cabling.

14 Claims, 10 Drawing Sheets

U.S. PATENT DOCUMENTS

| | | | | |
|---|---|---|---|---|
| 4,932,910 | A | 6/1990 | Hayday | |
| 4,944,656 | A | 7/1990 | Feng et al. | |
| D312,889 | S | 12/1990 | Swadell | |
| D321,693 | S | 11/1991 | Mailandt | |
| D367,480 | S | 2/1996 | Bacnik | |
| 5,570,546 | A | 11/1996 | Butterworth et al. | |
| 5,611,176 | A * | 3/1997 | Juengert et al. | 52/40 |
| D383,138 | S | 9/1997 | Harada | |
| D388,101 | S | 12/1997 | Harada | |
| 5,757,324 | A | 5/1998 | Helms et al. | |
| 5,787,649 | A * | 8/1998 | Popowych et al. | 52/40 |
| D407,707 | S | 4/1999 | Jones | |
| 5,943,980 | A | 8/1999 | Huang | |
| 5,963,178 | A | 10/1999 | Jones | |
| D428,361 | S | 7/2000 | Jones | |
| 6,122,866 | A | 9/2000 | Thomas et al. | |
| 6,343,440 | B1 * | 2/2002 | Ayers | 52/40 |
| 6,434,889 | B1 * | 8/2002 | Jones | 52/40 |
| 2001/0013212 | A1 * | 8/2001 | Jimenez Sanchez et al. | 52/736.1 |
| 2004/0113861 | A1 | 6/2004 | Jackson et al. | |

* cited by examiner

SYSTEM, METHOD AND APPARATUS FOR SUPPORTING AND CONCEALING RADIO ANTENNAS

RELATED APPLICATIONS

This application claims the benefit of U.S. Provisional Patent Applications Ser. No. 60/807,598, filed Jul. 17, 2006, entitled "System, Method and Apparatus for Supporting and Concealing Radio Antennas" which is hereby incorporated by reference in its entirety.

BACKGROUND

1. Field

The present invention relates to antenna support structures, and more particularly to a system, method, and apparatus that supports and conceals radio antennas.

2. Background

The widespread growth of wireless communications has resulted in a dramatic increase the number of radio antennas placed throughout communities. While consumer demand for increased coverage and capability of wireless communications system continues to increase, and thereby increase the need for more antennas, there is resistance by the same customers for the placement of the antennas. Typically, radio antennas are not aesthetically pleasing and are generally not well received by the local communities.

Therefore, there is a need for improved antenna placement that is more aesthetically pleasing.

SUMMARY

The present invention includes methods, apparatuses, and systems as described in the written description and claims. In one embodiment, a multi-trunk antenna structure includes a main trunk and a plurality of upper trunks. The upper trunks extend upwardly, at a desired angle, from the main trunk, thereby providing a desired girth of the structure near the top. The structure also includes a plurality of antennas attached to desired upper trunks at a desired height above ground level. The plurality of antennas can be adjusted to desire azimuths.

The multi-trunk antenna structure can include an antenna attached to each upper trunk. In addition, the plurality of antennas can include a plurality of multi-element antenna arrays. In one embodiment, the multi-trunk antenna structure includes three upper trunks. In other embodiments, the multi-trunk antenna structure can include any four, five, six, or any desired number of upper trunks. The upper trunks can also include cable raceways for installation of cables.

The multi-trunk antenna structure can also include a plurality of branches protruding of the upper trunks. In one embodiment, the structure resembles a Eucalyptus tree. In another embodiment, the structure resembles an Oak tree.

In an embodiment, a multi-trunk antenna structure that resembles a Eucalyptus tree includes a main trunk and a plurality of upper trunks. The upper trunks extend upwardly, at a desired angle, from the main trunk, thereby providing a desired girth of the structure near the top. The structure also includes a plurality of antennas. Antennas are attached to desired upper trunks at a desired heights above ground level. The azimuth of the antennas are adjusted to a desire azimuth A plurality of simulated Eucalyptus tree branches are attached to the main trunk and the plurality of upper trucks, thereby concealing the plurality of antennas and making the structure resemble a Eucalyptus tree.

The plurality of antennas can include a plurality of multi-element antenna arrays. Also, the structure can include any desired number of upper trunks. In addition, the upper trunks can include raceways for cable installation.

Other features and advantages of the present invention should be apparent after reviewing the following detailed description and accompanying drawings which illustrate, by way of example, aspects of the invention.

BRIEF DESCRIPTION OF THE DRAWINGS

These and other aspects, advantages and details of the present invention, both as to its structure and operation, may be gleaned in part by a study of the accompanying exemplary drawings, in which like reference numerals refer to like parts. The drawings are not necessarily to scale, emphasis instead being placed upon illustrating the principles of the invention.

DETAILED DESCRIPTION

Figure 1:
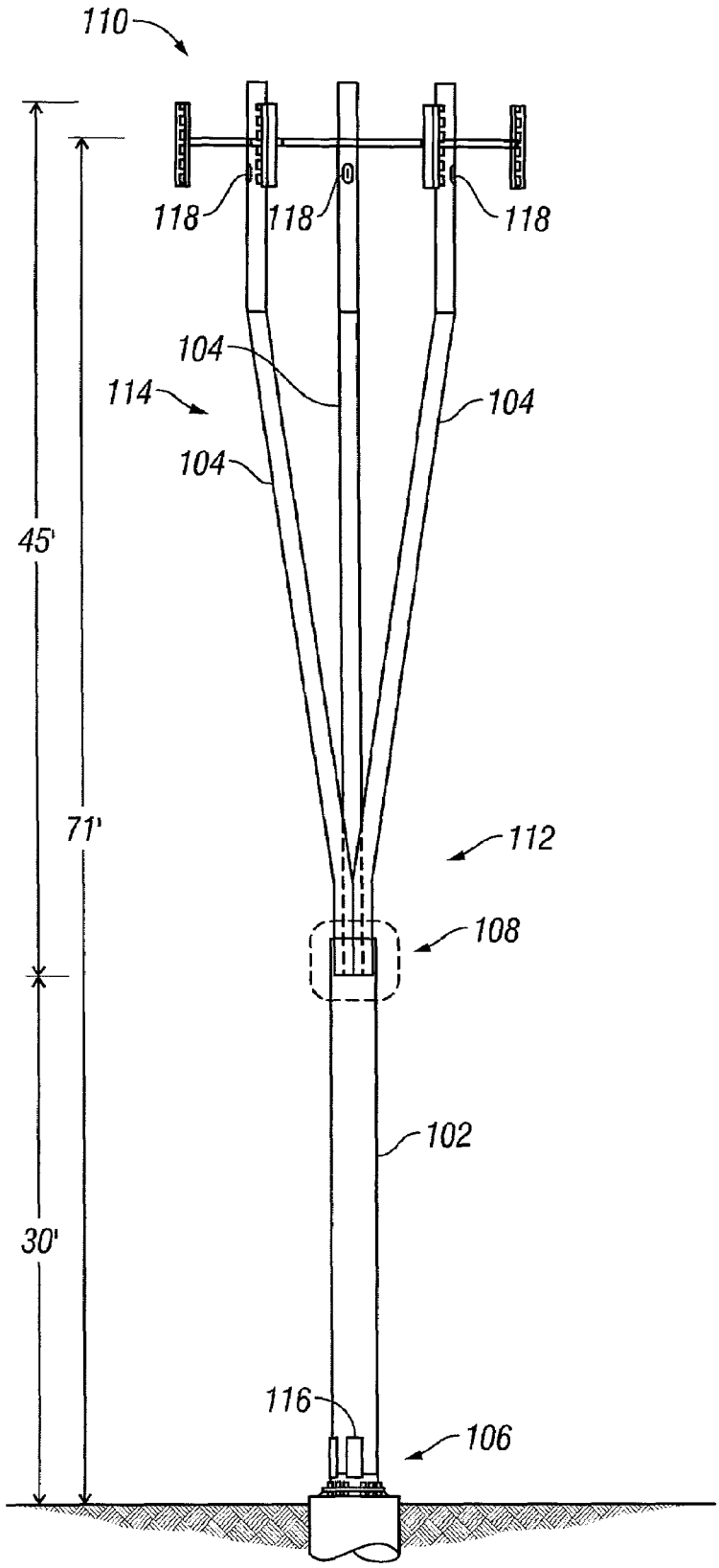
FIG. 1 is an elevation view of an example embodiment of a multi-trunk antenna installation.

Certain embodiments as disclosed herein provide for methods and systems for communication over a broadband wireless air interface. After reading this description it will become apparent how to implement the invention in various alternative embodiments and alternative applications. However, although various embodiments of the present invention will be described herein, it is understood that these embodiments are presented by way of example only, and not limitation. As such, this detailed description of various alternative embodiments should not be construed to limit the scope or breadth of the present invention as set forth in the appended claims.

There have been some attempts to conceal antennas. For example, if antennas are place on a building, such as a rooftop, there have been boxes, cupolas, and other structures to cover the antennas. While this technique may have some success in industrial, or commercial, areas they are generally not as acceptable in residential and urban areas. Also, homeowners are usually reluctant to allow antennas to be placed on their property for many reasons, including an adverse effect on the property value.

To improve the aesthetics of radio antenna installations techniques have been developed to conceal the installation in a pleasing manner. Prior attempts at improving the aesthetics of antenna installation have been to use a single pole design. In these types of installations, a single pole is erected and the antennas, and supporting structure, are attached to the top portion of the pole. Cabling is routed from the antennas down through the center of the pole to the bottom where it exits the pole and connects to other equipment. Examples of this type of installation include flag poles, and single trunk type tree structures, like palm trees and pine trees.

A drawback to the single pole types of designs is the limited options available for the antenna placement. For example, a flag pole design usually has "bulges" or "humps" around the circumference of the pole. Due to the limited amount of area around the pole circumference, the size and placement of the antennas is very limited.

In a single trunk tree design, there is usually a support structure for mounting the antennas attached near the top of the pole that is acting as the tree trunk. Similarly to the flag pole design, the cabling is usually routed down the center of the pole. The support structure provides some increased flexibility in mounting the antennas, but it still suffers from a drawback of how far the antenna can extend from the central pole. For example, the support structure and pole need to provide sufficient mechanical stability that the antennas do not move more that a desired amount, even when exposed to winds up to 80 miles per hour, as can occur during a storm. Excessive movement of the antenna can have a very negative impact upon the performance of the antenna. In general, the farther that the antenna support structure extends from the central pole the more susceptible the structure will be to movement. In addition, single trunk trees are generally conical shape, being larger near the base and getting smaller near the top. The decrease area near the top of the pole also limits the distance that the antennas may be located from the central pole.

Multi-Trunk Design

An improvement over the single pole antenna installations is a multi-trunk, or multi-branch, antenna tower installation. FIG. 1 is an elevation view of an example embodiment of a multi-trunk antenna installation. As shown in FIG. 1, the multi-trunk antenna includes a main trunk 102 and multiple upper trunks 104. One end 106 of the main trunk 102 is connected to a foundation, or otherwise anchored to the ground. The other end 108 of the main trunk 102 is used to support the multiple upper trunks 104 that extend upwardly and outward at a desired angle, from the main trunk 102. At a desired location of the upper trunks 104 an antenna array 110 is placed.

In one embodiment, the antenna array 100 can include multiple individual antennas, or multiple antenna arrays. For example the antenna array 110 can include multi-element arrays located on each upper trunk 104 to make the antenna array 110.

In addition, the embodiment illustrated in FIG. 1 shows an antenna installed on each of the upper trunks 104. In other embodiments multiple antennas can be installed on a single upper trunk, or there can be upper trunks that do not include an antenna.

As shown in FIG. 1, the upper trunks 104 in this example have a slight bend near the end 112 of the upper trunk 104 attached to the main trunk 102. The amount, or angle, of bend is selected to provide a desired separation between the tops of the upper trunks 104 and thereby provide a desired width, or girth, to the structure. In the example of FIG. 1, near the top end 114 of the upper trunks 104, there is another bend such that the end portion of the upper trunks 104 are generally plumb, or vertical. In some installations, having the end of the upper trunks 104 vertical ease the mounting of the antenna arrays 110. In other embodiments, the upper trunks 104 may not have a vertical section at the end, or as described further below, the antennas in the array 110 may be located on portions of the upper trunks 104 that are not vertical. If the antennas in the array 110 are located on non-vertical portions of the upper trunks, or it is desired to mount the antennas at a non vertical angle, then an antenna mounting structure can be adapted to adjust the position of the antenna to a desired position.

The main trunk 102 and upper trunks 104 can be made so that the antennas in the array 110 are located at a desired height above ground level. For example, in FIG. 1, the main trunk 102 is approximately 30 feet tall and the upper trunks are approximately 45 feet tall so that a centerline of the antenna array 110 is located approximately 71 feet above ground level.

Figure 2:
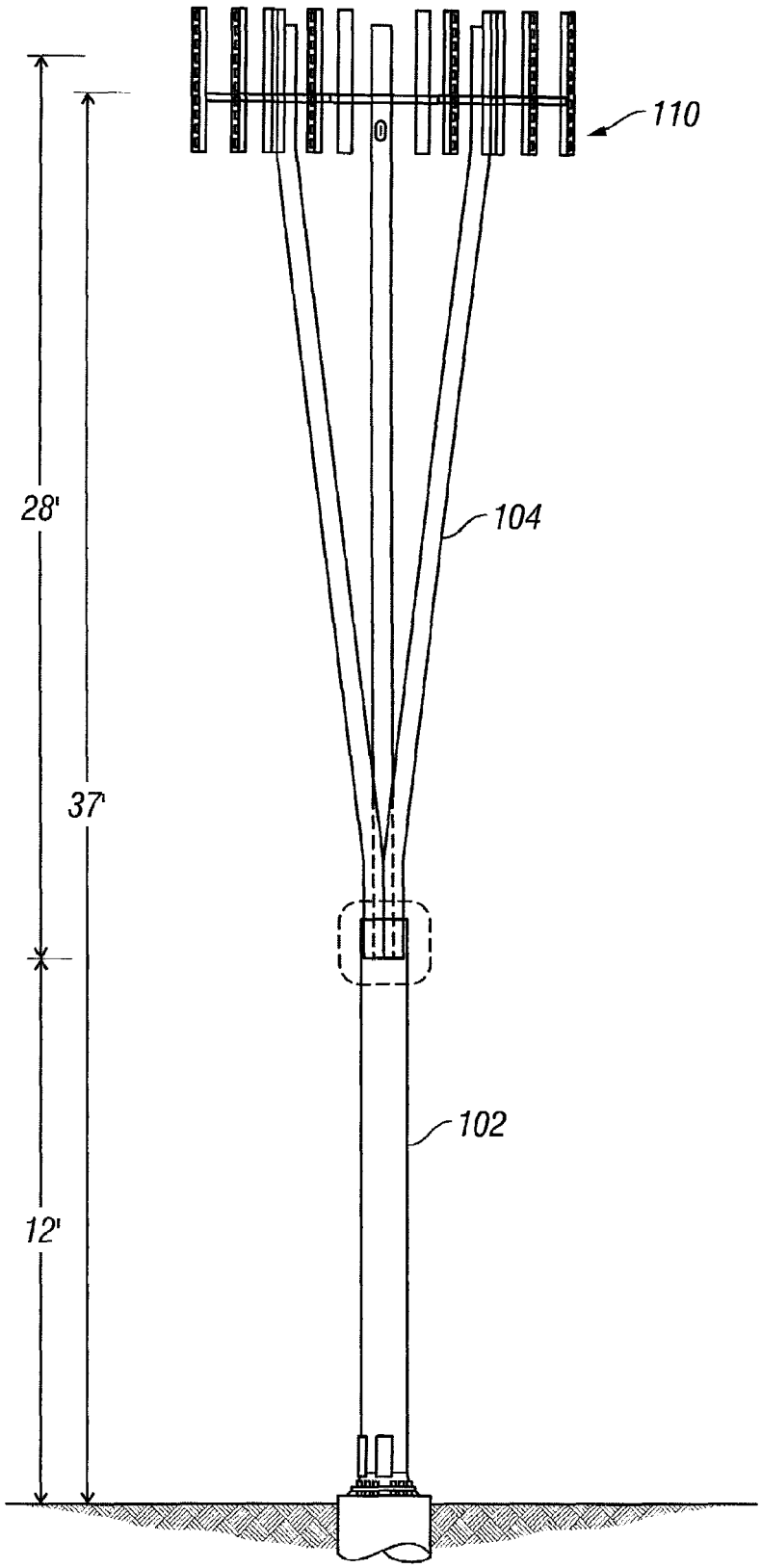
FIG. 2 is an elevation drawing of another example embodiment of a multi-trunk monopole antenna installation.

FIG. 2 is an elevation drawing of another example embodiment of a multi-trunk monopole antenna installation. In FIG. 2, the main trunk 102 is approximately 12 feet tall and the upper trunks 104 are approximately 28 feet tall so that the centerline of the antenna array 110 is located approximately 37 feet above ground level. Varying the lengths of the main trunk 102 and upper trunks 104 supports locating antenna arrays 110 at any desired height.

Figure 3:
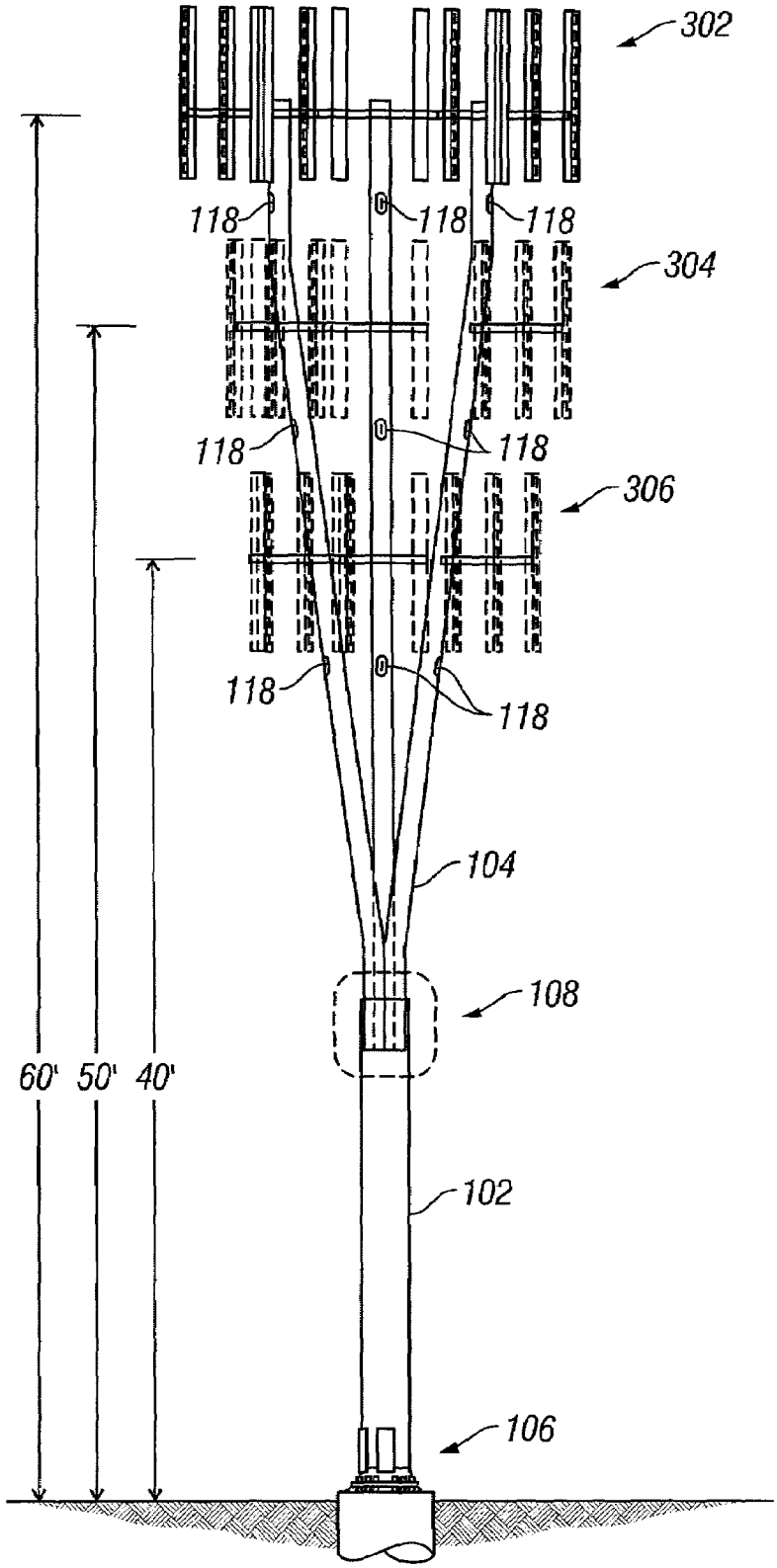
FIG. 3 is an elevation view of yet another example embodiment of a multi-trunk antenna installation.

FIG. 3 is an elevation view of yet another example embodiment of a multi-trunk antenna installation. In FIG. 3, the upper trunks 104 are adapted to allow installation of multiple antennas upon each upper trunk 104. As shown in FIG. 3, there are multiple antenna arrays installed at different locations on the upper trunks 104. In FIG. 3, a first antenna array 302 is located near the top of the upper trunks 104, at a height of approximately 60 feet above ground level. A second antenna array 304 is locate below the first antenna array 302 at a height of approximately 50 feet above ground level, and a third antenna array 306 is located below the second antenna array 304, at a height of approximately 40 feet above ground level.

The technique of varying the lengths of the main trunk 102 and the upper trunks 104 can also be combined with the technique of placing antenna arrays at various locations along the upper trunks 104. Thus, by using these techniques, either individually or in combination, the location of antenna arrays can be at any desired height above ground level.

Returning to FIG. 1, in one embodiment in the base of the main trunk 102 there is at least one access port 116, and in each of the upper trunks 104 there is at least one access port 118. The access ports provide an opening for cables to enter and exit the upper trunks 104 and the main trunk 102 which act as raceways for the cables to pass through the multi-trunk antenna installation. Another aspect is that each antenna assembly has its own upper truck, and therefore, its own cable raceway from the top of the main trunk 102 to the antenna.

Returning to FIG. 3, in the base of the main trunk 102 there is at least one access port 116, and in each of the upper trunks 104 there is at least one access port 118 at each of the antenna array locations 302, 304, and 306. Again, the access ports 118 provide an opening for cables to enter and exit the upper trunks 104 at each of the antennas on each of the upper trunks.

In one embodiment the upper trunks 104 have "smooth" bends so that the upper trunks 104 in combination with the main trunk 102 provide a smooth raceway with no abrupt, or sharp, bends. Thus, the raceway eases cable installation, minimizes, or eliminates the need for splices or additional pull boxes, and can also support larger cables to be pulled through the raceway. Use of larger cable, and reduction in splices, helps to conserve the "link budget" of the cabling system between the ground equipment and the antennas.

Another advantage of the multi-trunk antenna installation is that antenna arrays can be installed on different upper trunks thereby increasing the separation between the antennas, while the upper trunk provides adequate mechanical structure of the antenna array. The increased separation between antennas provides increased flexibility in configuring the antenna placement.

Figure 4:
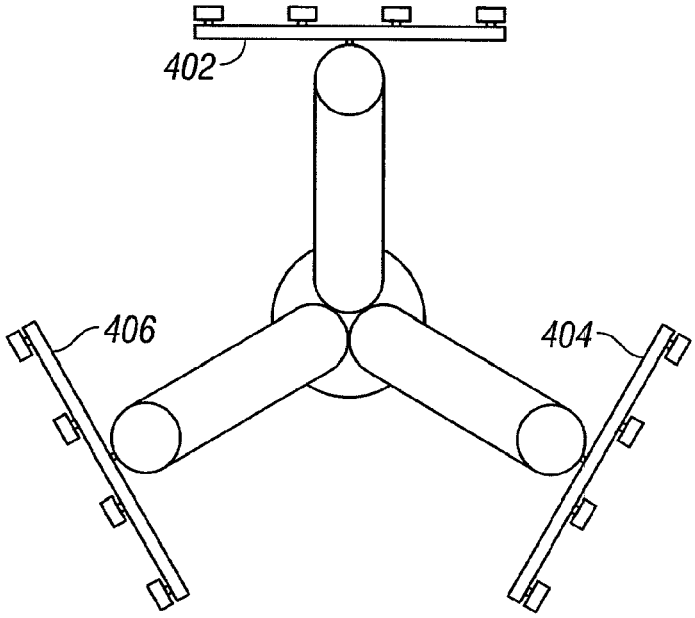
FIG. 4 is a cross section drawing of three multi-element antenna arrays 402, 404, and 406, similar to the antenna arrays 110 illustrated in FIG. 1.

FIG. 4 is a cross section drawing of three multi-element antenna arrays 402, 404, and 406, similar to the antenna arrays 110 illustrated in FIG. 1. As shown in the example of FIG. 4, the three antennas array 402, 404, and 406 can correspond to three sectors of a cell site. The first antenna array 402 is at azimuth 0 degrees, the second antenna array 404 is at azimuth 140 degrees, and the third antenna array is at azimuth 240 degrees. As shown in FIG. 4, the azimuth of each of the antenna arrays 402, 404, and 406 can be adjust to any desired azimuth.

Figure 5:
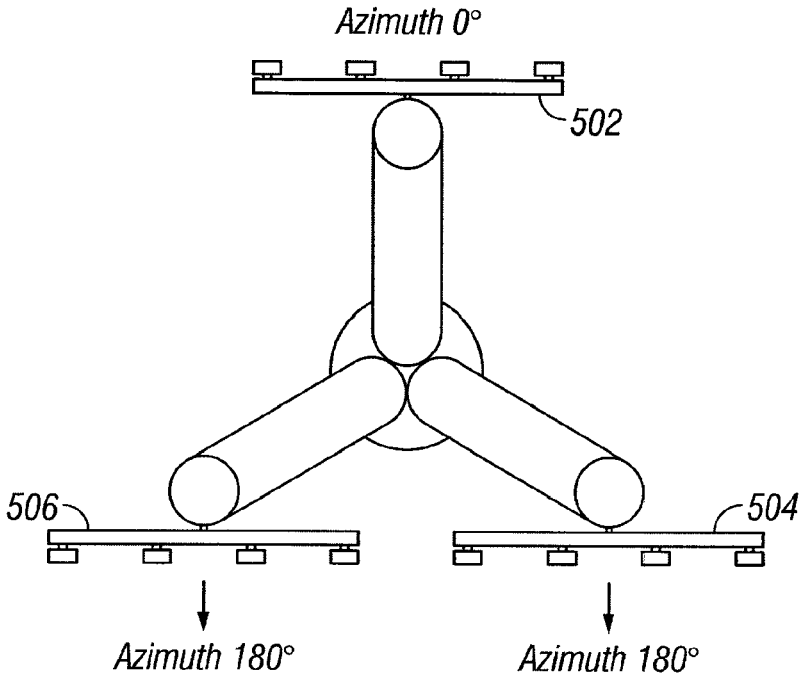
FIG. 5 is a cross section drawing of three multi-element antenna arrays 502, 504, and 506 with the azimuths of the antenna arrays being adjustable.

FIG. 5 is a cross section drawing of three multi-element antenna arrays 502, 504, and 506 with the azimuths of the antenna arrays being adjustable. In the example of FIG. 5 the first antenna array 502 is at azimuth 0 degrees and antenna arrays 504 and 506 are both at azimuth 180 degrees. The azimuth settings in FIGS. 4 and 5 are only illustrative, and the azimuth of the antennas can be adjusted to any desired setting. In other words, any desired azimuth settings for the antenna arrays are possible. As FIGS. 4 and 5 illustrate, the multi-trunk antenna installation provides the flexibility to have many different antenna configurations.

Figure 6A:
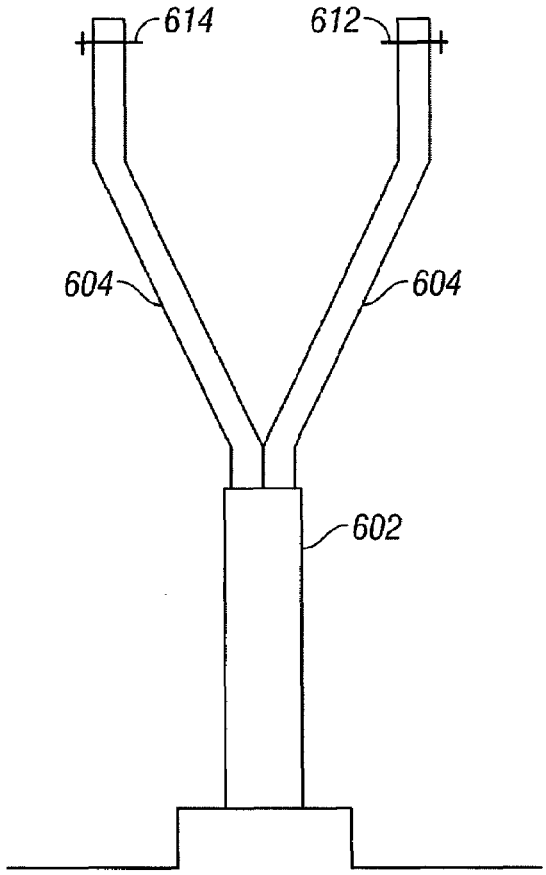
FIG. 6A is an elevation view of an example embodiment of a multi-trunk antenna installation with four upper trunks.
Figure 6B:
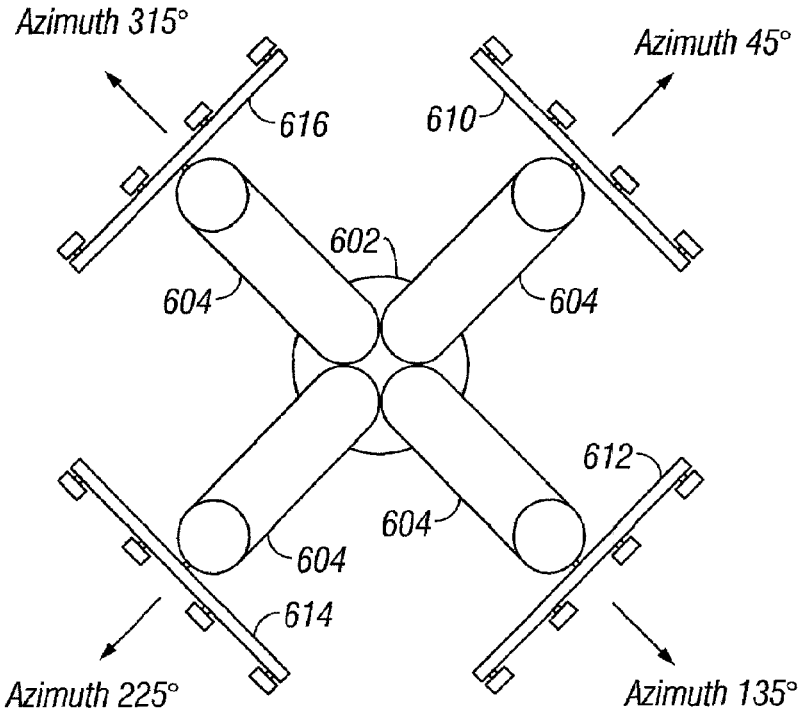
FIG. 6B is a top view of the multi-trunk antenna installation of FIG. 6A.

In the examples of FIGS. 1-5 there are three upper trunks 104. In other embodiments, there may be different numbers of upper trunks, for example, two, four, five, six, seven, eight, or any number of upper trunks desired to provide the design characteristics desired. FIG. 6A is an elevation view of an example embodiment of a multi-trunk antenna installation with four upper trunks. FIG. 6B is a top view of the multi-trunk antenna installation of FIG. 6A. As shown in FIG. 6A there is a main trunk 602 and four upper trunks 604, only two of which are visible in the elevation view. Attached to each of the upper trunks 604 is an antenna array 612 and 614 (only two antenna arrays are visible in the elevator view).

In FIG. 6B the four antenna arrays 610, 612, 614, and 616 are illustrated. In the example of FIG. 6B, the antenna arrays 610, 612, 614, and 616 are at azimuths of 45 degrees, 135 degrees, 225 degrees, and 315 degrees respectively. Of course, as noted above, the azimuths of the antenna arrays can be adjusted to any desires azimuth.

Figure 7A:
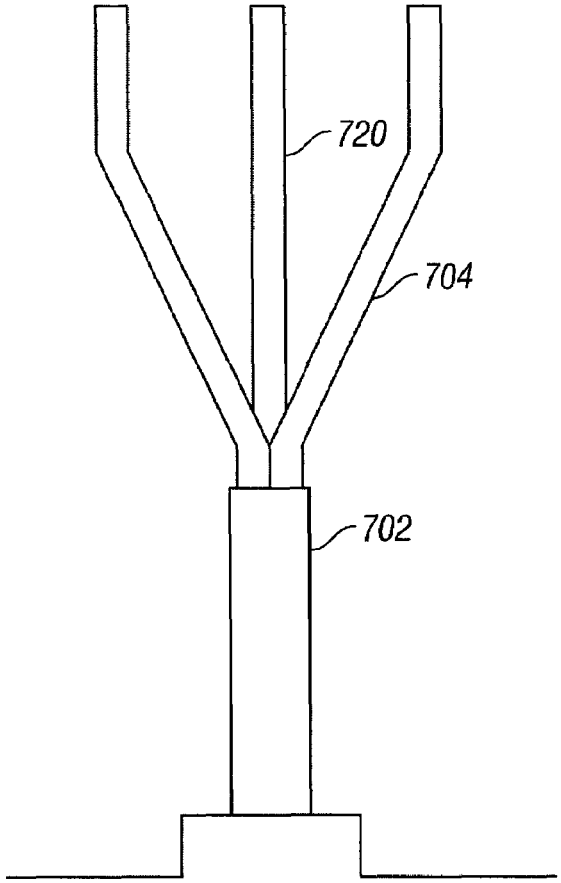
FIG. 7A is an elevation view of an exemplary multi-trunk antenna installation with five upper trunks.
Figure 7B:
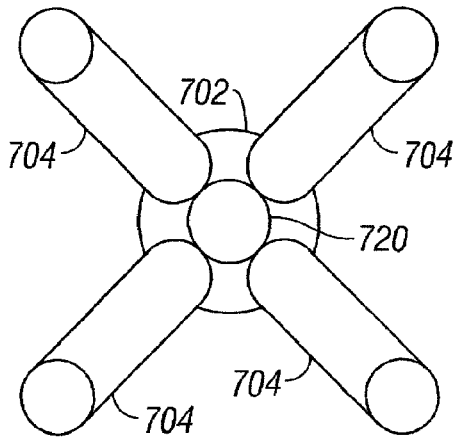
FIG. 7B is a top view of the multi-trunk antenna installation of FIG. 7A.

FIGS. 7A and 7B are yet another example of a multi-trunk antenna installation. FIG. 7A is an elevation view of an exemplary multi-trunk antenna installation with five upper trunks. FIG. 7B is a top view of the multi-trunk antenna installation of FIG. 7A. In the example of FIGS. 7A and 7B the multi-trunk antenna installation includes four curved upper trunks 702 and a straight center upper trunk 720. For clarity, there are no antenna arrays illustrated on the upper trunks of the multi-trunk antenna installation in FIGS. 7A and 7B.

The number of upper trunks, may be influenced by the number of sectors in a cell site, or as described further below, by the aesthetics desired for the final installation. For example, a multi-trunk antenna design can be fabricated to resemble a Eucalyptus tree, or an Oak tree, or any other "bulbous" structure where there is a large girth at the top, or at a top end, of the structure. Thus, multi-trunk structures provide an additional benefit because they support a wide range of aesthetic structures that are not available with a single pole design.

Figure 8:
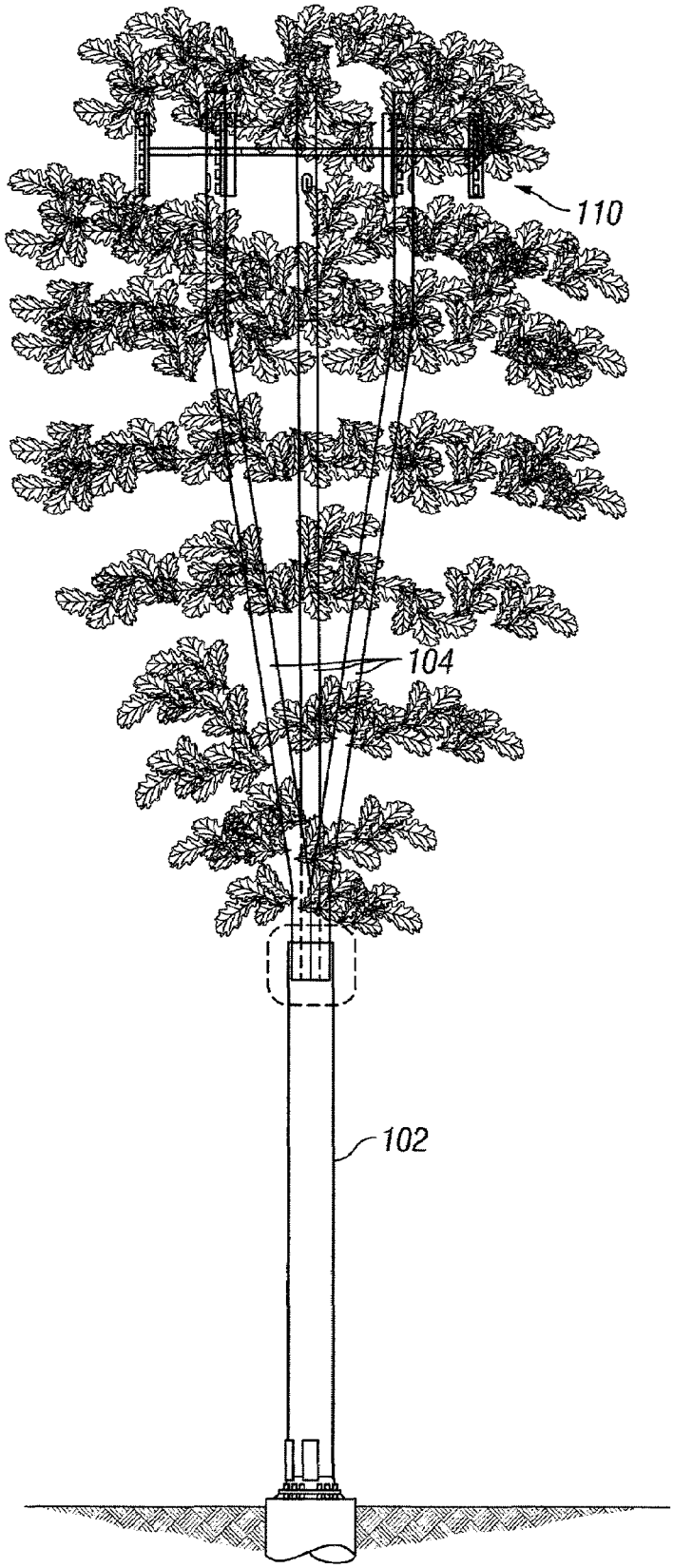
FIG. 8 is a an elevation drawing of the multi-trunk antenna installation of FIG. 1 configured to resemble a Eucalyptus tree.

FIG. 8 is a an elevation drawing of the multi-trunk antenna installation of FIG. 1 configured to resemble a Eucalyptus tree. As illustrated in FIG. 8, the structure of the multi-trunk antenna designs provides the desired girth for an aesthetically pleasing design while also concealing the antenna arrays. In FIG. 8, there are antennas 110 located near the top of the upper trunks 104. The example illustrated in FIG. 8 shows the multi-trunk antenna installation allows for large separation between the individual antennas. In addition, the upper trunks 104 provide mechanical support as well as cable raceways for the antennas.

Figure 9:
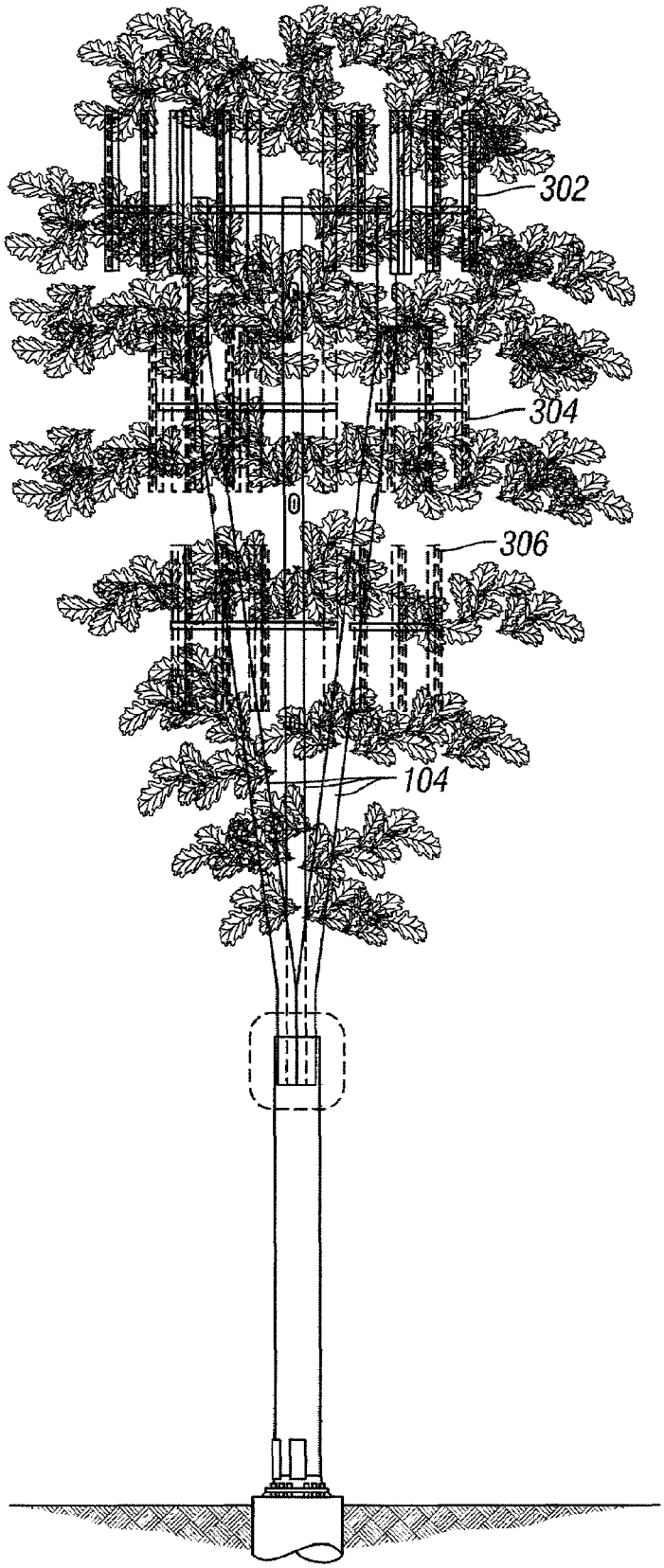
FIG. 9 is a an elevation drawing of the multi-trunk antenna installation of FIG. 3 configured to resemble a Eucalyptus tree.

FIG. 9 is a an elevation drawing of the multi-trunk antenna installation of FIG. 3 configured to resemble a Eucalyptus tree. In FIG. 9, there are three sets of antenna arrays 302, 304, and 306, located on the upper trunks 104. As illustrated in FIGS. 8 and 9, the multi-trunk antenna installations are well configured to produce aesthetically pleasing antenna installations.

Figure 10A:
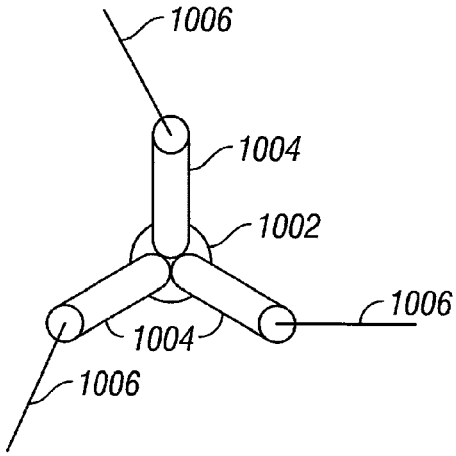
FIG. 10A is a cross section view of an elevation of a multi-trunk antenna installation.
Figure 10B:
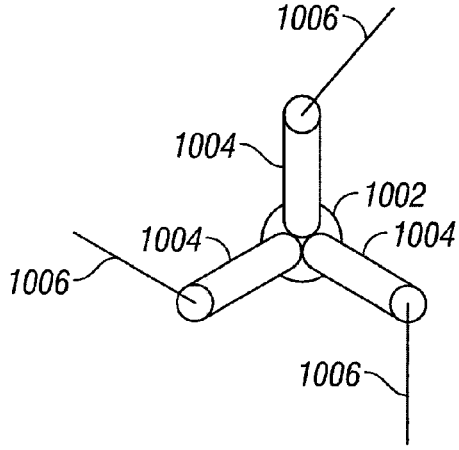
FIG. 10B is another cross section view of a higher elevation of the multi-trunk antenna installation.

FIGS. 10A-10D illustrate one example of the placement of branches that simulate a tree on a multi-trunk antenna. FIG. 10A is a cross section view of an elevation of a multi-trunk antenna installation. As shown in FIG. 10A a main trunk 1002 supports three upper trunks 1004. Protruding outward from the upper trunks are branches 1006. The branches can simulate many different types of tress, such as an Oak tree or Eucalyptus tree, or other desired type of tree. FIG. 10B is another cross section view of a higher elevation of the multi-trunk antenna installation. As shown in the example of FIG. 10B the branches protrude from the upper trucks 1004 at different angles than illustrated in FIG. 10A.

Figure 10C:
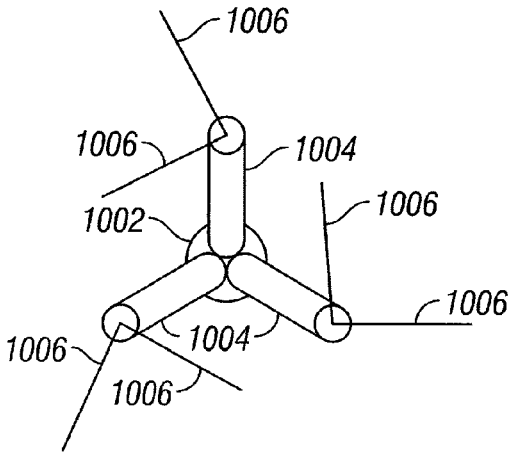
FIG. 10C is yet another cross section view of a yet higher elevation of the multi-trunk antenna installation.
Figure 10D:
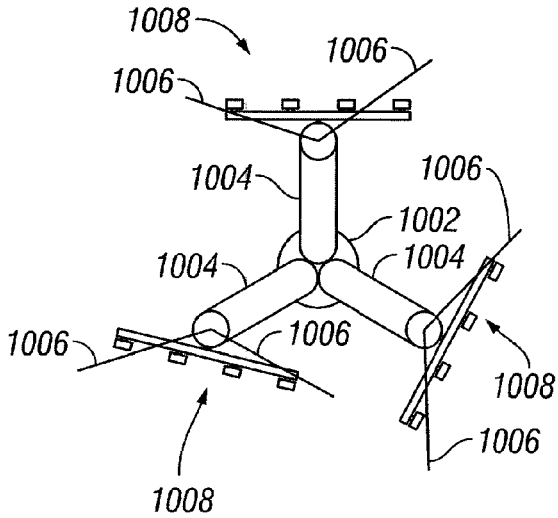
FIG. 10D is still another cross section view of a still higher elevation of the multi-trunk antenna installation.

FIG. 10C is yet another cross section view of a yet higher elevation of the multi-trunk antenna installation. As shown in the example of FIG. 10C two branches now protrude from the upper trucks 1004. FIG. 10D is still another cross section view of a still higher elevation of the multi-trunk antenna installation. As shown in the example of FIG. 10D the branches protrude from the upper trucks 1004 at different angles than illustrated in FIG. 10C. Also illustrated in FIG. 10D are three multi-element antennas 1008 that are being concealed by the branches. In the example illustrated in FIGS. 10A-10D, the branches are installed in a spiraling fashion thereby providing full coverage and a realistic look.

Figure 11:
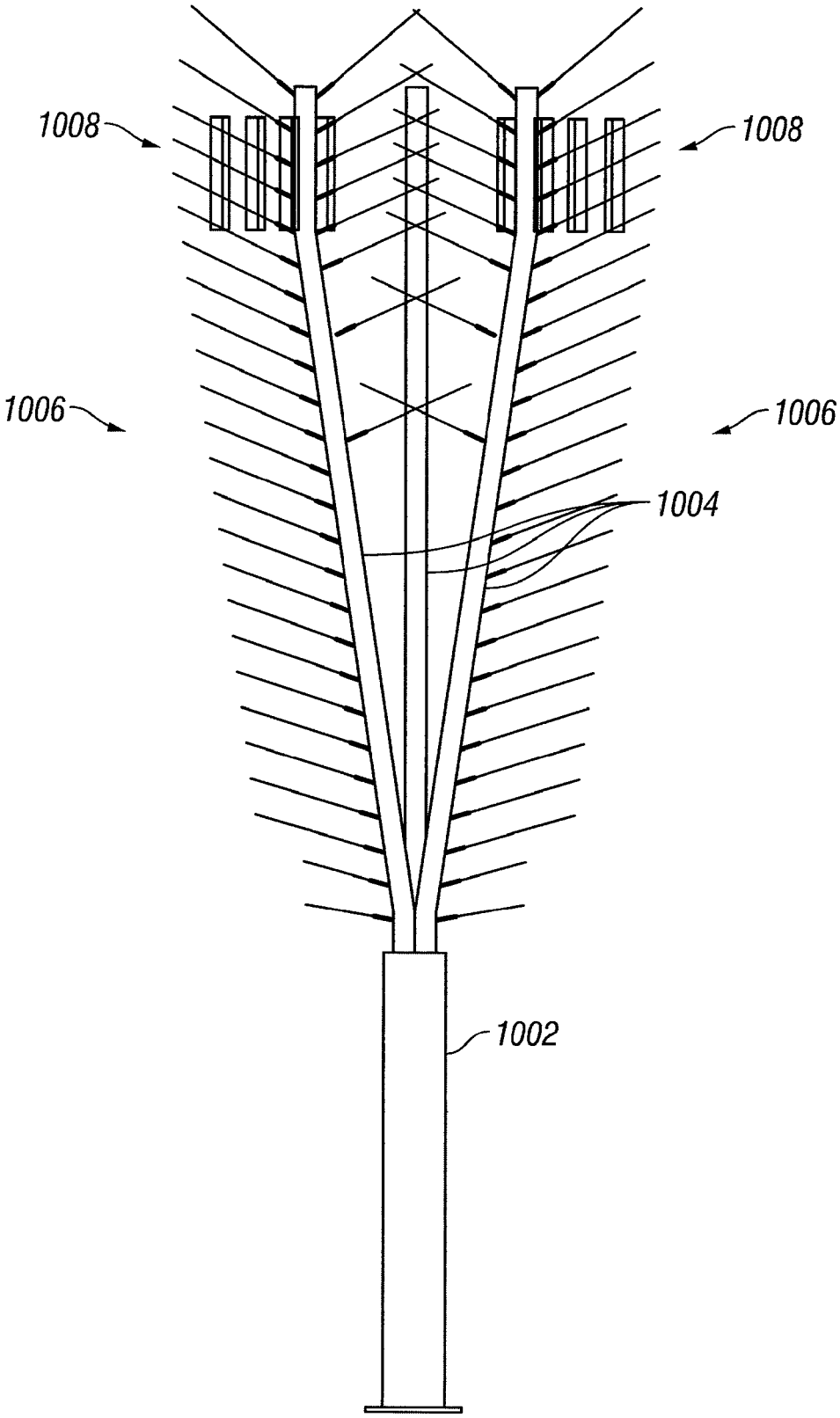
FIG. 11 is an elevation view of the multi-trunk antenna installation of FIGS. 10A-10D.

FIG. 11 is an elevation view of the multi-trunk antenna installation of FIGS. 10A-10D. As shown in FIG. 11, the main trunk 1002 supports the upper trunks 1004. The upper trunks support the multi-element antennas 1008. Protruding from the upper trunks 1004 are branches 1006 that conceal the antennas 1008 and also provide a realistic looking tree structure.

While FIGS. 10A-10D and 11 illustrate an example with three upper trunks 1004, any desired number of upper trunks can be used. Also, the embodiment of FIGS. 10A-10D and 11 do not illustrates branches protruding from the main trunk

1002. In other embodiments, there can be branches protruding from the lower trunk, as well as any desired portion of the antenna installation.

It is noted that the different embodiments described for multi-trunk antenna designs provide very good stability for the antennas. For example, structural analysis and testing indicate that the multi-trunk antenna design provide sufficient mechanical stability that the antennas do not move more that a desired amount, even when exposed to winds up to 80 miles per hour, as can occur during a storm.

Another advantage to the multi-trunk antenna designs is that they are modular. For example, in FIG. 1, the main trunk 102, upper trunks 104 and antennas 110 can all be fabricated and shipped separately. In one example, the main trunk 102 and upper trunks 104 can be shipped on a flatbed, or other type of transport, and then assembled at a jobsite. In addition, the modular design provides easy assembly because there are only a few main pieces that need to be assembled at the jobsite. And, as noted earlier, because of the design, with its large smooth raceways, pulling cable is easier also aiding in the assembly procedures.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent exemplary embodiments of the invention and are therefore representative of the subject matter which is broadly contemplated by the present invention.

The invention claimed is:

1. A multi-trunk antenna structure comprising:

a main trunk;

a plurality of upper trunks that extend upwardly, at a desired angle, from the main trunk, thereby providing a desired girth of the structure near the top; and a plurality of antennas attached to desired upper trunks at desired heights above ground level, and the antennas adjusted to a desire azimuth.

2. The multi-trunk antenna structure of claim 1, wherein there is an antenna attached to each upper trunk.

3. The multi-trunk antenna structure of claim 1, wherein the plurality of antennas comprise a plurality of multi-element antenna arrays.

4. The multi-trunk antenna structure of claim 1, wherein plurality of upper trunks comprises three upper trunks.

5. The multi-trunk antenna structure of claim 1, wherein plurality of upper trunks comprises four upper trunks.

6. The multi-trunk antenna structure of claim 1, wherein the upper trunks comprise raceways for installation of cables.

7. The multi-trunk antenna structure of claim 1, further comprising a plurality of branches protruding of the plurality of upper trunks.

8. The multi-trunk antenna structure of claim 7, wherein the structure resembles a Eucalyptus tree.

9. The multi-trunk antenna structure of claim 7, wherein the structure resembles an Oak tree.

10. A multi-trunk antenna structure that resembles a Eucalyptus tree, the structure comprising:

a main trunk;

a plurality of upper trunks that extend upwardly, at a desired angle, from the main trunk, thereby providing a desired girth near the top of the structure;

a plurality of antennas attached to desired upper trunks at desired heights above ground level, the antennas adjusted to desire azimuths; and a plurality of simulated Eucalyptus tree branches attached to the main trunk and the plurality of upper trucks, thereby concealing the plurality of antennas and making the structure resemble a Eucalyptus tree.

11. The multi-trunk antenna structure of claim 10, wherein the plurality of antennas comprise a plurality of multi-element antenna arrays.

12. The multi-trunk antenna structure of claim 10, wherein plurality of upper trunks comprises three upper trunks.

13. The multi-trunk antenna structure of claim 10, wherein plurality of upper trunks comprises four upper trunks.

14. The multi-trunk antenna structure of claim 10, wherein the upper trunks comprise raceways for installation of cables.

* * * * *